US010670290B2

(12) United States Patent
Mori

(10) Patent No.: US 10,670,290 B2
(45) Date of Patent: Jun. 2, 2020

(54) MULTI AIR CONDITIONER

(71) Applicant: DAIKIN INDUSTRIES, LTD., Osaka-Shi, Osaka (JP)

(72) Inventor: Takashige Mori, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 16/321,381

(22) PCT Filed: Jun. 27, 2017

(86) PCT No.: PCT/JP2017/023541

§ 371 (c)(1),
(2) Date: Jan. 28, 2019

(87) PCT Pub. No.: WO2018/020934

PCT Pub. Date: Feb. 1, 2018

(65) Prior Publication Data

US 2019/0162435 A1 May 30, 2019

(30) Foreign Application Priority Data

Jul. 28, 2016 (JP) ..... 2016-148894

(51) Int. Cl.
*F24F 11/30* (2018.01)
*F24F 11/62* (2018.01)
(Continued)

(52) U.S. Cl.
CPC ..... *F24F 11/30* (2018.01); *F24F 3/065* (2013.01); *F24F 11/62* (2018.01); *F24F 11/54* (2018.01); *F25B 2313/023* (2013.01)

(58) Field of Classification Search
CPC .. F24F 11/30; F24F 3/065; F24F 11/62; F24F 11/54; F25B 2313/023
See application file for complete search history.

(56) References Cited

U.S. PATENT DOCUMENTS 8,239,922 B2 * 8/2012 Sullivan ..... F24F 11/0009 236/51

FOREIGN PATENT DOCUMENTS

CN 103383128 A 11/2013
EP 2056032 B1 2/2012
(Continued)

OTHER PUBLICATIONS

International Search Report for PCT/JP2017/023541 (PCT/ISA/210) dated Aug. 8, 2017.
(Continued)

*Primary Examiner* — Carlos R Ortiz Rodriguez
(74) *Attorney, Agent, or Firm* — Birch, Stewart, Kolasch & Birch, LLP

(57) ABSTRACT

Electricity wasting due to an unnecessary operation is prevented and the usability is improved. A multi air conditioner includes an outdoor unit, a first indoor unit and a second indoor unit. The first indoor unit and the second indoor unit are connected to the outdoor unit and are respectively disposed in different rooms. When the first indoor unit is operated based on a first operating mode, if an operation start instruction based on a second operating mode which is different from the first operating mode is sent to the second indoor unit from a remote controller without using an internet (S5: YES, S7: NO), the first indoor unit becomes an operation stop state and the second indoor unit starts an operation based on the second operating mode on condition that the last instruction to the first indoor unit is sent from a smart phone via the internet (S9: YES) (S12).

4 Claims, 3 Drawing Sheets

(51) Int. Cl.
*F24F 3/06* (2006.01)
*F24F 11/54* (2018.01)

(56) References Cited

FOREIGN PATENT DOCUMENTS

| | | | |
|---|---|---|---|
| EP | 2 674 822 | A1 | 12/2013 |
| JP | 5-302765 | A | 11/1993 |
| JP | 2000-193288 | A | 7/2000 |
| JP | 2001-165490 | A | 6/2001 |
| JP | 2011-52847 | A | 3/2011 |
| JP | 2014-202418 | A | 10/2014 |
| JP | 2015-94513 | A | 5/2015 |
| JP | 2015-124901 | A | 7/2015 |

OTHER PUBLICATIONS

Extended European Search Report dated Feb. 28, 2020 in corresponding European Application No. 17833943.8.

* cited by examiner

MULTI AIR CONDITIONER

TECHNICAL FIELD

The present invention relates to a multi air conditioner.

BACKGROUND ART

In Patent Literature 1, the following is suggested: a multi air conditioner including an outdoor unit, and a first indoor unit and a second indoor unit which are respectively connected to the outdoor unit and are disposed in different rooms. In the multi air conditioner disclosed in Patent Literature 1, the earliest operation instruction to either the first indoor unit or the second indoor unit is prioritized. For example, when a heating operating mode is instructed to the second indoor unit while a cooling operation is performed by the first indoor unit in response to an instruction to perform the cooling operating mode having been sent to the first indoor unit, the cooling operation of the first indoor unit is maintained, and the second indoor unit is kept in an operation stop state.

CITATION LIST

Patent Literature

[Patent Literature 1] Japanese Unexamined Patent Publication No. 2001-165490

SUMMARY OF INVENTION

Technical Problem

In the multi air conditioner disclosed in Patent Literature 1, even if a user is not in a first room in which the first indoor unit is disposed and another user is in a second room in which the second indoor unit is disposed, when the operating mode later-instructed to the second indoor unit is different from the operating mode previously-instructed to the first indoor unit, the second indoor unit does not start the operation and the first indoor unit is kept being operated unnecessarily. This may cause problems such as electricity wasting due to an unnecessary operation and poor usability.

An object of the present invention is to provide a multi air conditioner which is configured to prevent electricity wasting due to an unnecessary operation and be able to improve the usability.

Solution to Problem

A multi air conditioner according to a first aspect of the present invention comprises an outdoor unit, a first indoor unit and a second indoor unit, the first indoor unit and the second indoor unit being connected to the outdoor unit and being respectively disposed in different rooms, wherein, when the first indoor unit is operated based on a first operating mode, if an operation start instruction based on a second operating mode is sent to the second indoor unit from a terminal device without using an internet, the first operating mode and the second operating mode being different from each other and being respectively selected from a plurality of operating modes, the first indoor unit becomes an operation stop state and the second indoor unit starts an operation based on the second operating mode on condition that the last instruction to the first indoor unit is sent from a portable terminal using an internet.

When the last instruction to the first indoor unit is sent from a portable terminal using an internet, it is determined that a user is not in a first room in which the first indoor unit is disposed. On the other hand, when an operation start instruction is sent to the second indoor unit from a terminal device without using an internet, it is determined that a user is in a second room. In such a case, even if the operating mode later-instructed to the second indoor unit is different from the operating mode previously-instructed to the first indoor unit, the unnecessary operation of the first indoor unit disposed in the first room where no user exists is stopped, whereas the operation of the second indoor unit disposed in the second room where the user exists is started. Thereby, electricity wasting due to an unnecessary operation is prevented and the usability can be improved.

In the multi air conditioner according to a second aspect of the present invention, the terminal device is a remote controller which is connected to the second indoor unit in a communicable manner, and is configured to send an instruction signal to the second indoor unit, the instruction signal including an operation start instruction signal which indicates the operation start instruction.

In the second aspect of the present invention, by using the remote controller as the terminal device, the user can easily instruct an operating mode.

In the multi air conditioner according to a third aspect of the present invention, the terminal device is a portable terminal which is connected to the second indoor unit in a communicable manner when an AP mode in which a wireless LAN is used as an access point is set and is configured to send an instruction signal to the second indoor unit, the instruction signal including an operation start instruction signal which indicates the operation start instruction.

In the third aspect of the present invention, by using the portable terminal as the terminal device, the user can easily instruct an operating mode.

In the multi air conditioner according to a fourth aspect of the present invention, when the first indoor unit is operated based on the first operating mode, if the operation start instruction based on the second operating mode is sent to the second indoor unit from the terminal device without using an internet, the first indoor unit becomes the operation stop state and the second indoor unit starts the operation based on the second operating mode on condition that the last instruction to the first indoor unit is sent from the portable terminal using an internet and a priority setting to prioritize the operation instruction is not set to the first indoor unit.

In the fourth aspect of the present invention, it is determined whether a priority setting is set to the first indoor unit or not, and when the priority setting is not set to the first indoor unit, the operation of the first indoor unit is stopped and the operation of the second indoor unit is started. Thereby, when the priority setting has been done to the first indoor unit, the operation stop of the first indoor unit is prevented, and the operation in line with the intension of the user is achieved.

Advantageous Effects of Invention

Electricity wasting due to an unnecessary operation is prevented and the usability can be improved.

DESCRIPTION OF EMBODIMENTS

The following describes an embodiment of the present invention with reference to attached drawings.

Figure 1:
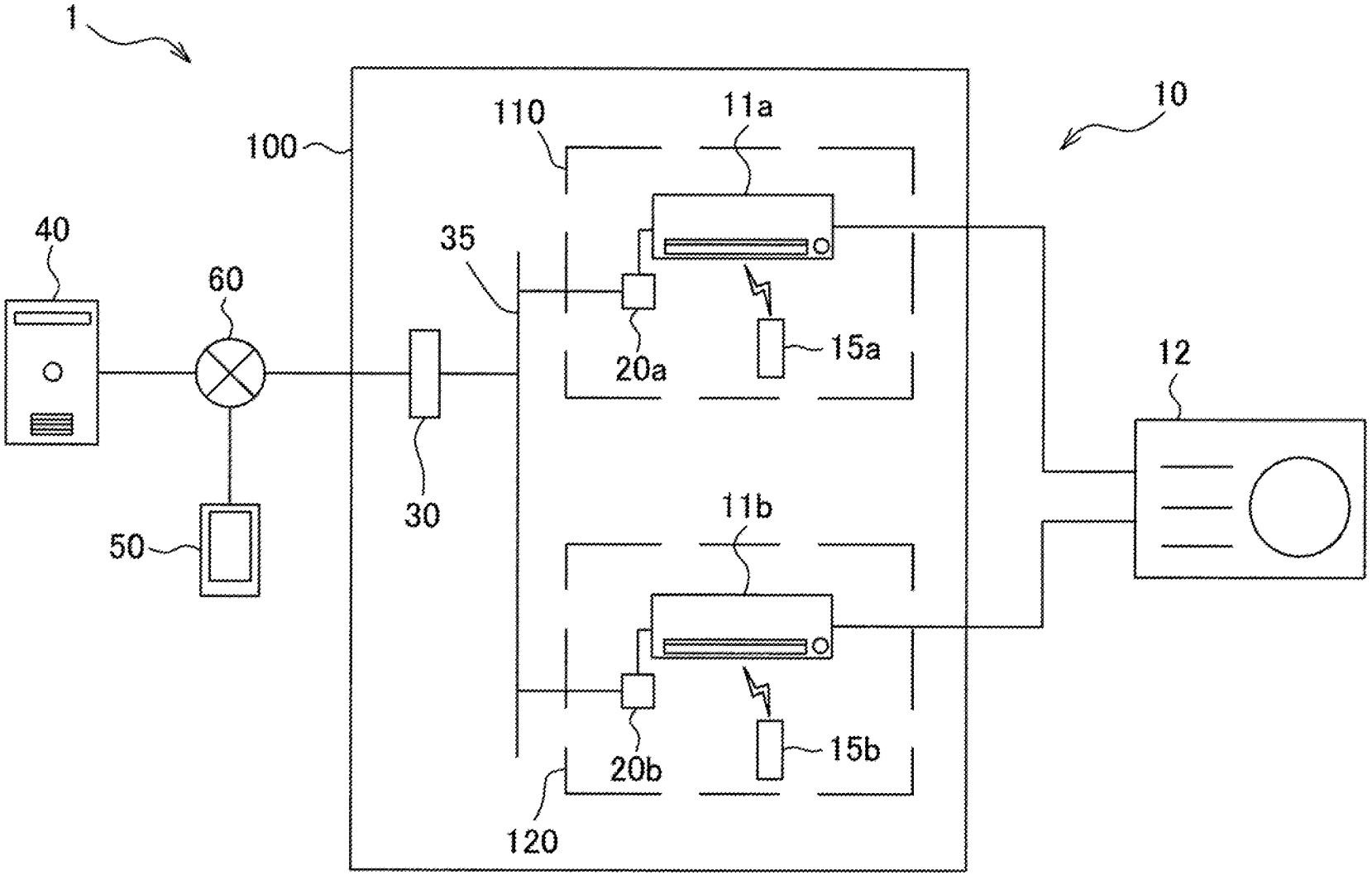
FIG. 1 is a schematic representation showing an air conditioning system including a multi air conditioner according to an embodiment of the present invention.

An air conditioning system 1 shown in FIG. 1 is provided with: a multi air conditioner 10 according to an embodiment of the present invention; adapters 20*a* and 20*b*; a router 30; a wireless LAN 35; a server 40; and a smart phone (portable terminal) 50. The smart phone 50 is possessed and operated by a user. The multi air conditioner 10 includes one outdoor unit 12 and two indoor units (a first indoor unit 11*a* and a second indoor unit 11*b*). The first indoor unit 11*a* and second indoor unit 11*b* are connected to the outdoor unit 12 via refrigerant pipes, respectively.

The followings are disposed in a building 100: the first indoor unit 11*a*; the second indoor unit 11*b*; the first adapter 20*a*; the second adapter 20*b*; the router 30; and the wireless LAN 35. The building 100 has a first room 110 and a second room 120 which is different from the first room 110. The first indoor unit 11*a* is disposed in the first room 110, and the second indoor unit 11*b* is disposed in the second room 120. The outdoor unit 12 is disposed outside of the building 100.

The router 30, the server 40 and the smart phone 50 are connected to an internet (public network) 60, respectively. The first adapter 20*a* and the second adapter 20*b* are respectively disposed in the first room 110 and the second room 120, and are respectively connected to the first indoor unit 11*a* and the second indoor unit 11*b* by wire. The first adapter 20*a* and the second adapter 20*b* are respectively connected to the internet 60 via the wireless LAN 35 and the router 30. With the above-described configuration, the smart phone 50 is connected to the first indoor unit 11*a* and the second indoor unit 11*b* in a communicable manner via the internet 60, the wireless LAN 35 and the adapters 20*a* and 20*b*.

The smart phone 50 can send an instruction signal to the first indoor unit 11*a* and/or the second indoor unit 11*b* via the internet 60, the wireless LAN 35 and the adapters 20*a* and 20*b*. Furthermore, a first remote controller 15*a* can send an instruction signal to the first indoor unit 11*a*, and a second remote controller 15*b* can send an instruction signal to the second indoor unit 11*b*. The first remote controller 15*a* is disposed in the first room 110 and is connected to the first indoor unit 11*a* in a communicable manner. The second remote controller 15*b* is disposed in the second room 120 and is connected to the second indoor unit 11*b* in a communicable manner.

Figure 2:
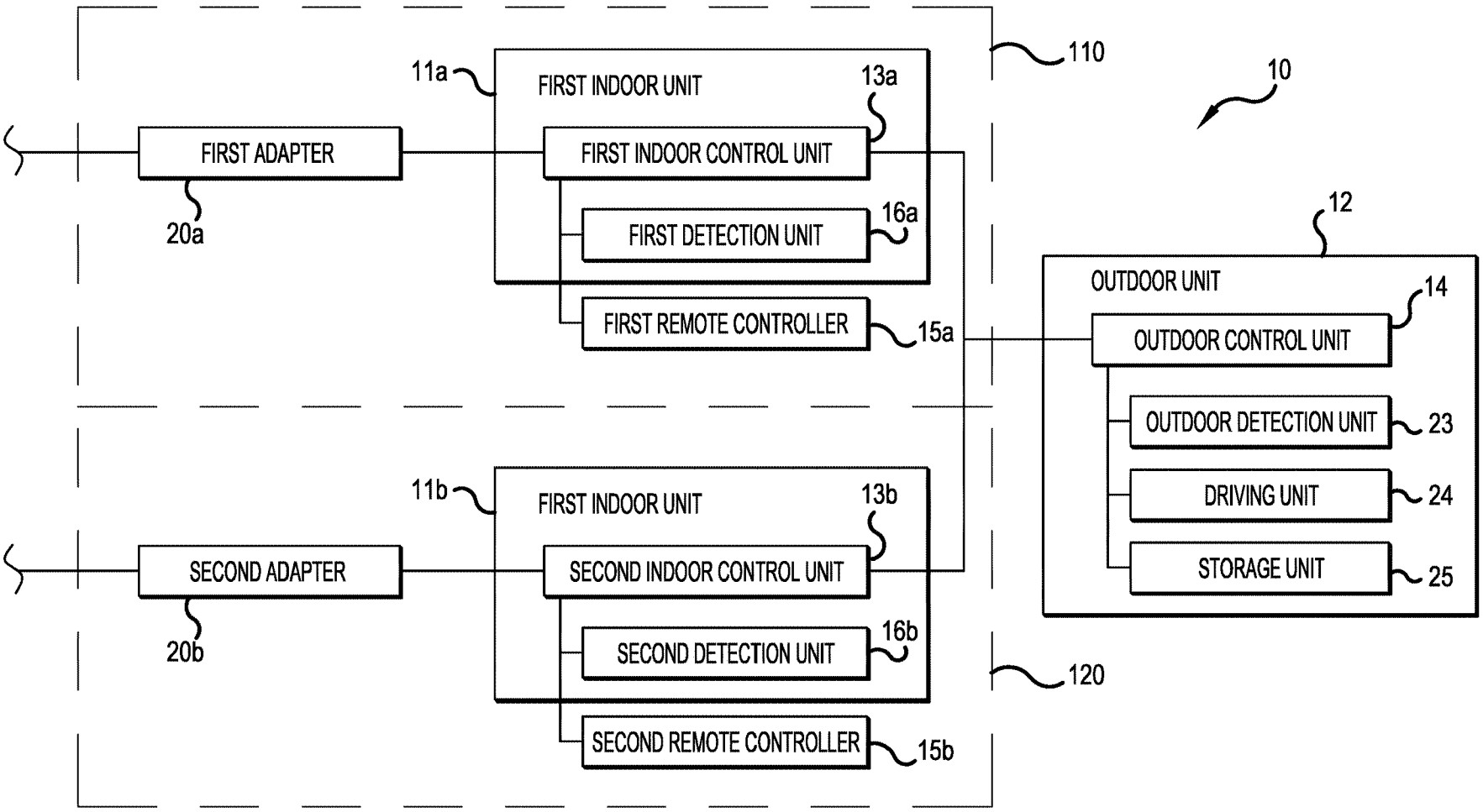
FIG. 2 is a block diagram of the multi air conditioner according to the embodiment of the present invention.

As shown in FIG. 2, the first indoor unit 11*a* includes a first indoor control unit 13*a* and a first detection unit 16*a*. The first indoor control unit 13*a* is connected to the first detection unit 16*a*, the first remote controller 15*a*, and the first adapter 20*a*. That is, each of the first remote controller 15*a* and the first adapter 20*a* is connected to the first indoor unit 11*a* in a communicable manner. The first detection unit 16*a* detects whether the instruction signal which is received by the first indoor unit 11*a* is sent from the first remote controller 15*a* or from the smart phone 50 via the first adapter 20*a*. The first remote controller 15*a* and the first adapter 20*a* are disposed outside of the first indoor unit 11*a* and inside of the first room 110.

Similarly to the above, the second indoor unit 11*b* includes a second indoor control unit 13*b* and a second detection unit 16*b*. The second indoor control unit 13*b* is connected to the second detection unit 16*b*, the second remote controller (terminal device) 15*b*, and the second adapter 20*b*. That is, each of the second remote controller 15*b* and the second adapter 20*b* is connected to the second indoor unit 11*b* in a communicable manner. The second detection unit 16*b* detects whether the instruction signal which is received by the second indoor unit 11*b* is sent from the second remote controller 15*b* or from the smart phone 50 via the second adapter 20*b*. The second remote controller 15*b* and the second adapter 20*b* are disposed outside of the second indoor unit 11*b* and inside of the second room 120.

The indoor control unit 13*a* receives an instruction signal which is sent from an adapter 20*a* or the remote controller 15*a*. The indoor control unit 13*b* receives an instruction signal which is sent from an adapter 20*b* or the remote controller 15*b*. Noted that the instruction signal sent from the adapter 20*a* is an instruction signal which is sent from the smart phone 50 to the indoor unit 11*a* using the internet 60, the wireless LAN 35 and the adapter 20*a*, and the instruction signal sent from the adapter 20*b* is an instruction signal which is sent from the smart phone 50 to the indoor unit 11*b* using the internet 60, the wireless LAN 35 and the adapter 20*b*. Noted that the instruction signal sent from the remote controller 15*a* is an instruction signal which is sent directly (that is, without using the internet 60) from the remote controller 15*a* to the indoor unit 11*a*, and the instruction signal sent from the remote controller 15*b* is an instruction signal which is sent directly (that is, without using the internet 60) from the remote controller 15*b* to the indoor unit 11*b*. The "instruction signal" includes signals such as: an operation start instruction signal which indicates a start of an operation; an operation stop instruction signal which indicates a stop of an operation; a mode selection signal to select an operating mode (cooling operation or heating operation); a temperature wind direction setting signal to set a temperature and/or wind direction; a priority setting signal to prioritize an operation instruction; and a timer setting signal to set a timer.

The outdoor unit 12 includes: an outdoor control unit 14; an outdoor detection unit 23; a driving unit 24; and a storage unit 25. The outdoor control unit 14 is connected to each of the outdoor detection unit 23, the driving unit 24, and the storage unit 25. The outdoor control unit 14 is connected to each of the indoor control units 13*a* and 13*b* via a communication line, and sends and receives an instruction signal to and from the indoor control units 13*a* and 13*b*. The outdoor control unit 14 controls the first indoor unit 11*a* based on an instruction signal sent from the first indoor control unit 13*a*, and controls the second indoor unit 11*b* based on an instruction signal sent from the second indoor control unit 13*b*. The outdoor detection unit 23 detects whether each of the indoor control units 13*a* and 13*b* receives an instruction signal. The driving unit 24 drives the first indoor unit 11*a* and/or the second indoor unit 11*b* based on the signal from the outdoor control unit 14. The storage unit 25 stores the instruction signal sent from the indoor control units 13*a* and 13*b* to the outdoor control unit 14.

Figure 3:
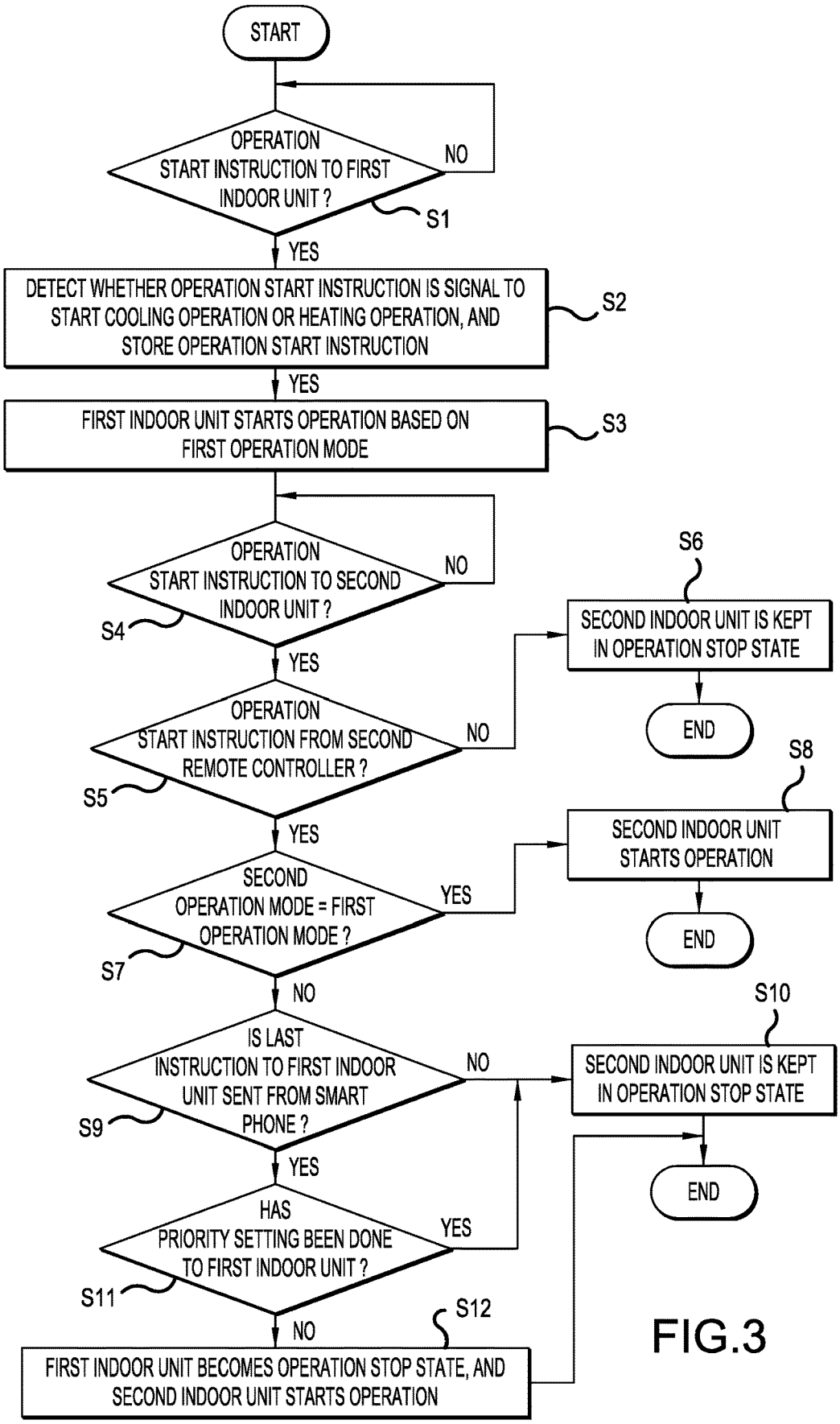
FIG. 3 is a flow chart showing operation control performed by the multi air conditioner according to the embodiment of the present invention.

Next, the following describes operation control executed by the multi air conditioner 10 with reference to FIG. 3.

Before the start of the flow in FIG. 3, the first indoor unit 11*a* and the second indoor unit 11*b* are in an operation stop state.

To begin with, the outdoor detection unit 23 detects whether the first indoor control unit 13*a* receives an operation start instruction signal (that is, the first indoor unit 11*a* is instructed to start an operation) or not (step S1). When the first indoor control unit 13*a* has not received an operation start instruction signal (step S1: NO), the step S1 is repeated.

When the first indoor control unit 13*a* has received an operation start instruction signal (step S1: YES), the outdoor detection unit 23 detects whether the operation start instruction signal is a signal instructing to start a cooling operation or a heating operation, and stores the operation start instruction signal in the storage unit 25 (step S2).

Here, noted that an operation start instruction to the first indoor unit 11*a* when the first indoor unit 11*a* and the second indoor unit 11*b* are in an operation stop state is called an operation start instruction based on a first operating mode. The first operating mode is selected from a plurality of operating modes. The plurality of operating modes include, for example, a cooling operation and a heating operation.

After step S2, the driving unit 24 causes the first indoor unit 11*a* to start an operation based on the first operating mode (step S3). In the present embodiment, the first operating mode is the cooling operation.

After step S3, the outdoor detection unit 23 detects whether the second indoor control unit 13*b* receives an operation start instruction signal (that is, the second indoor unit 11*b* is instructed to start an operation) or not (step S4). When the second indoor control unit 13*b* has not received an operation start instruction signal (step S4: NO), the step S4 is repeated.

When the second indoor control unit 13*b* has received an operation start instruction signal (step S4: YES), whether the operation start instruction signal has been sent from the second remote controller 15*b* without using the internet 60 is detected (step S5). Then, the second detection unit 16*b* sends the detection result to the outdoor control unit 14.

When the operation start instruction signal is not a signal sent from the second remote controller 15*b* without using the internet 60 (that is, a signal sent from the smart phone 50 using the Internet 60) (step S5: NO), it is determined that the user is outside of the second room 120 (that is, the user is not in the second room 120). In this case, the outdoor control unit 14 cancels the operation start instruction signal, and causes the second indoor unit 11*b* to be kept in the operation stop state (step S6). After step S6, the flow ends.

When the operation start instruction signal is a signal sent from the second remote controller 15*b* without using the internet 60 (step S5: YES), it is determined that the user is in the second room 120. In this case, the outdoor control unit 14 detects whether the second operating mode instructed by the operation start instruction signal sent from the second remote controller 15*b* is the same cooling operation as the first operating mode or not (step S7). When the second operating mode is the same as the first operating mode (step S7: YES), the outdoor control unit 14 controls the driving unit 24 and causes the second indoor unit 11*b* to start the operation while maintaining the operation of the first indoor unit 11*a* (step S8). After step S8, the flow ends.

When the second operating mode is the heating operation and is different from the first operating mode (step S7: NO), the first detection unit 16*a* detects whether the instruction signal, which has been received by the first indoor control unit 13*a* immediately before the operation start instruction is sent to the second indoor unit 11*b* in step S4, is a signal which is sent from the smart phone 50 using the internet 60 (that is, the last instruction to the first indoor unit 11*a* has been sent from the smart phone 50 using the internet 60) or not (step S9). The detection result is sent to the outdoor control unit 14.

Noted that the "instruction signal" mentioned in the phrase "the last instruction signal which has been received by the first indoor control unit 13*a* " includes signals such as: an operation start instruction signal; a mode selection signal; a temperature wind direction setting signal; a priority setting signal; and a timer setting signal. In regard to this, the "instruction" mentioned in the phrase "the last instruction to the first indoor unit 11*a* " includes instructions such as: an operation start instruction; selection of an operating mode after the start of an operation; a setting of a temperature and/or wind direction; a priority setting; and a timer setting.

When the last instruction to the first indoor unit 11*a* is not sent from the smart phone 50 using the internet 60 (that is, is sent from the first remote controller 15*a* without using the internet 60) (step S9: NO), it is determined that the user is in the first room 110. In this case, the outdoor control unit 14 cancels the operation start instruction signal which has been received by the second indoor control unit 13*b* in step S4, and causes the second indoor unit 11*b* to be kept in the operation stop state (step S10). After step S10, the flow ends.

When the last instruction to the first indoor unit 11*a* is sent from the smart phone 50 using the internet 60 (step S9: YES), it is determined that the user is outside of the first room 110 (that is, the user is not in the first room 110). In this case, the outdoor control unit 14 further determines whether a priority setting has been done to the first indoor unit 11*a* or not (step S11).

When a priority setting has been done to the first indoor unit 11*a* (step S11: YES), the process shifts to step S10, and the outdoor control unit 14 cancels the operation start instruction signal which has been received by the second indoor control unit 13*b* in step S4, and causes the second indoor unit 11*b* to be kept in the operation stop state. After step S10, the flow ends.

When a priority setting has not been done to the first indoor unit 11*a* (step S11: NO), the outdoor control unit 14 adopts the operation start instruction signal which has been received by the second indoor control unit 13*b* in step S4. Specifically, the outdoor control unit 14 causes the first indoor unit 11*a* to be in the operation stop state and causes the driving unit 24 to start an operation of the second indoor unit 11*b* based on the second operating mode (step S12). After step S12, the flow ends.

[Characteristics of Multi Air Conditioner of the Present Embodiment]

The multi air conditioner 10 of the present embodiment has the following characteristics.

When the last instruction to the first indoor unit 11*a* has been done by the smart phone 50 using the internet 60 (S9: YES), it is determined that the user is outside of the first room 110 (the user is not in the first room 110). On the other hand, when an operation start instruction to the second indoor unit 11*b* is made by the second remote controller 15*b* without using the internet 60 (S5: YES), it is determined that the user is in the second room 120. In such a case, even if the operating mode later-instructed to the second indoor unit 11*b* is different from the operating mode previously-instructed to the first indoor unit 11*a* (S7: NO), the unnecessary operation of the first indoor unit 11*a* disposed in the first room 110 where the user does not exist is stopped, whereas the operation of the second indoor unit 11*b* disposed in the second room 120 where the user exists is started (step S12). Thereby, electricity wasting due to an unnecessary operation is prevented and the usability can be improved.

Noted that a terminal device of the present embodiment is the second remote controller 15*b* which is connected to the second indoor unit 11*b* in a communicable manner and is configured to send an instruction signal to the second indoor unit 11*b*, the instruction signal including an operation start instruction signal which indicates the operation start instruction. In this way, by using a remote controller as a terminal device, the user can easily instruct an operating mode.

Furthermore, in the present embodiment, it is determined whether a priority setting has been done to the first indoor unit 11*a* or not (step S11), and when the priority setting has not been done to the first indoor unit 11*a* (step S11: NO), the operation of the first indoor unit 11*a* is stopped and the operation of the second indoor unit 11*b* is started (step S12). Thereby, when the priority setting has been done to the first indoor unit 11*a*, the operation stop of the first indoor unit 11*a* is prevented, and the operation in line with the intension of the user is achieved.

The following will describe a multi air conditioner of another embodiment of the present invention.

The present embodiment is different from the above-described embodiment in a point that a terminal device is not a second remote controller 15*b*. In the present embodiment, the terminal device is connected to the second indoor unit 11*b* in a communicable manner when in AP mode in which the wireless LAN 35 is used as an access point is set, and is a smart phone (portable terminal) 50 which sends an instruction signal to the second indoor unit 11*b*. The portable terminal is not limited to a smart phone, and may be devices such as a tablet-type device.

Specifically, when a button provided on the second remote controller 15*b* is pushed for a predetermined time, a control unit embedded in the second remote controller 15*b* causes the adapter 20*b* to be in a set-up mode. The set-up mode includes the AP mode. In the AP mode, the wireless LAN 35 is used as an access point. That is, in the AP mode, the smart phone 50 is connected to the wireless LAN 35 via the router 30 without using the internet 60, and is connected to the second indoor unit 11*b* in a communicable manner. In the AP mode, an instruction signal can be sent from the smart phone 50 to the second indoor unit 11*b*. In this way, by using the smart phone 50 as a terminal device, the user can easily instruct an operating mode.

An embodiment of the present invention has been described. It should be noted that the present invention is not limited to the above-described embodiment, is defined by the scope of the appended claims, and shall encompass the equivalents in the meaning of the claims and every modification within the scope of the claims.

In the above-described embodiment, the first operating mode is the cooling operation and the second operating mode is the heating operation. However, the disclosure is not limited to this. For example, the first operating mode may be the heating operation, and the second operating mode may be the cooling operation. Either of the first operating mode or the second operating mode may be a dehumidifying operation, and the other operating mode may be a humidifying operation. Either of the first operating mode or the second operating mode may be a fan-only operation and the other operating mode may be the cooling operation. That is, plural operating modes may include operations such as: a cooling operation; a heating operation; a dehumidifying operation; a humidifying operation; and a fan-only operation. A combination of the first operating mode and the second operating mode can adopt various patterns such as the dehumidifying operation, the humidifying operation, and the fan-only operation.

In the above-described embodiment, when the last instruction to the first indoor unit 11*a* has been sent from the smart phone 50 using the internet 60 (S9: YES), it is determined whether the priority setting has been done to the first indoor unit 11*a* or not (step S11). Then, when the priority setting has not been done to the first indoor unit 11*a* (step S11: NO), the operation of the first indoor unit 11*a* is stopped and the operation of the second indoor unit 11*b* is started (step S12). However, the step S11 may be omitted. That is, when the last instruction to the first indoor unit 11*a* has been sent from the smart phone 50 using the internet 60 (S9: YES), the operation of the first indoor unit 11*a* may be stopped and the operation of the second indoor unit 11*b* may be started without the determination in step S11.

In the above-described embodiment, the multi air conditioner includes two indoor units, but may include three or more indoor units. When two indoor units or three or more indoor units are provided, any of the indoor units may be selected as the first indoor unit and the second indoor unit.

REFERENCE SIGNS LIST

10 multi air conditioner
11*a* first indoor unit
11*b* second indoor unit
12 outdoor unit
15*a* first remote controller
15*b* second remote controller (terminal device)
35 wireless LAN
50 smart phone (portable terminal, terminal device)
60 internet
110 first room
120 second room

The invention claimed is:

1. A multi air conditioner comprising:

an outdoor unit, a first indoor unit, a second indoor unit, the first indoor unit and the second indoor unit being connected to the outdoor unit and being respectively disposed in different rooms and configured to operate in a plurality of operating modes, including a first operating mode and a second operating mode different from the first operating mode, and a detection unit connected to the first and second indoor units, the detection unit being configured to detect whether an instruction signal received by the respective indoor unit was directly sent from a terminal device or indirectly sent from a portable device using an external public network;

wherein, when the first indoor unit is operating in the first operating mode based on an instruction signal sent from the portable device using an external public network, if an operation start instruction signal based on the second operating mode is directly sent to the second indoor unit from athe terminal device without using the external public network, the first indoor unit is commanded to an operation stop state and the second indoor unit starts operating in the second operating mode.

2. The multi air conditioner according to claim 1, wherein, the terminal device is a remote controller which is connected to the second indoor unit in a communicable manner, and is configured to send an instruction signal to the second indoor unit, the instruction signal including an operation start instruction signal which indicates the operation start instruction.

3. The multi air conditioner according to claim 1, wherein, the terminal device is a portable terminal which is connected to the second indoor unit in a communicable manner when an AP mode in which a wireless LAN is used as an access point is set and is configured to send an instruction signal to the second indoor unit, the instruction signal including an operation start instruction signal which indicates the operation start instruction.

4. The multi air conditioner according to claim 1, wherein, when the first indoor unit is operating in the first operating mode based on an instruction signal sent from the portable device using the external public network and a priority setting to prioritize the operation instruction is not set to the first indoor unit, if the operation start instruction signal based on the second operating mode is directly sent to the second indoor unit from the terminal device without using the external public network, the first indoor unit is commanded to the operation stop state and the second indoor unit starts operating in the second operating mode.

* * * * *